US007503397B2

(12) United States Patent
Giroux et al.

(10) Patent No.: US 7,503,397 B2
(45) Date of Patent: Mar. 17, 2009

(54) APPARATUS AND METHODS OF SETTING AND RETRIEVING CASING WITH DRILLING LATCH AND BOTTOM HOLE ASSEMBLY

(75) Inventors: Richard Lee Giroux, Cypress, TX (US); Albert C. Odell, II, Kingwood, TX (US); Gary Thompson, Katy, TX (US); David Haugen, League City, TX (US); Tuong Thanh Le, Katy, TX (US); Robert Dugal, Houston, TX (US); Karsten Heidecke, Houston, TX (US); David Shahin, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 223 days.

(21) Appl. No.: 11/193,582

(22) Filed: Jul. 29, 2005

(65) Prior Publication Data

US 2006/0032638 A1 Feb. 16, 2006

Related U.S. Application Data

(60) Provisional application No. 60/592,708, filed on Jul. 30, 2004.

(51) Int. Cl.
*E21B 19/18* (2006.01)

(52) U.S. Cl. ..... 166/385; 166/77.1; 166/77.2; 166/241.5

(58) Field of Classification Search ..... 166/377, 166/385, 386, 77.1, 77.2, 95.1, 241.5, 242.2
See application file for complete search history.

(56) References Cited

U.S. PATENT DOCUMENTS

| | | | |
|---|---|---|---|
| 122,514 | A | 1/1872 | Bullock |
| 179,973 | A | 7/1876 | Thornton |
| 1,077,772 | A | 11/1913 | Weathersby |

(Continued)

FOREIGN PATENT DOCUMENTS

| | | |
|---|---|---|
| CA | 2 307 386 | 11/2000 |

(Continued)

OTHER PUBLICATIONS

G H. Kamphorst, G. L. Van Wechem, W. Boom, D. Bottger, and K. Koch, Casing Running Tool, SPE/IADC 52770.

(Continued)

*Primary Examiner*—William P Neuder
(74) *Attorney, Agent, or Firm*—Patterson & Sheridan, LLP

(57) ABSTRACT

In one embodiment, a top drive system for drilling with casing is provided with an access tool to retrieve a downhole tool. The top drive system for drilling with casing comprises a top drive; a top drive adapter for gripping the casing, the top drive adapter operatively coupled to the top drive; and an access tool coupled to the top drive and adapted for accessing a fluid passage of the top drive system. In another embodiment, a method for retrieving a downhole tool through a tubular coupled to a top drive adapter of a top drive system is provided. The method comprises coupling an access tool to the top drive system, the access tool adapted to provide access to a fluid path in the top drive system and inserting a conveying member into the fluid path through the access tool.

54 Claims, 14 Drawing Sheets

U.S. PATENT DOCUMENTS

| | | | |
|---|---|---|---|
| 1,185,582 | A | 5/1916 | Bignell |
| 1,301,285 | A | 4/1919 | Leonard |
| 1,342,424 | A | 6/1920 | Cotten |
| 1,414,207 | A | 4/1922 | Reed |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,184,681 | A | 12/1939 | Osmun et al. |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,818 | A | 3/1945 | Silverman |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Musinger |
| 2,569,390 | A | 9/1951 | Sewell |
| 2,570,080 | A | 10/1951 | Stone |
| 2,582,987 | A | 1/1952 | Hagenbook |
| 2,595,902 | A | 5/1952 | Stone |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,965,177 | A | 12/1960 | Bus, Sr. et al. |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,191,683 | A | 6/1965 | Alexander |
| 3,193,116 | A | 7/1965 | Kenneday et al. |
| 3,266,582 | A | 8/1966 | Homanick |
| 3,305,021 | A | 2/1967 | Lebourg |
| 3,321,018 | A | 5/1967 | McGill |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Welner |
| 3,624,760 | A | 11/1971 | Bodine |
| 3,635,105 | A | 1/1972 | Dickmann et al. |
| 3,638,989 | A | 2/1972 | Sandquist |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,697,113 | A | 10/1972 | Palauro et al. |
| 3,700,048 | A | 10/1972 | Desmoulins |
| 3,706,347 | A | 12/1972 | Brown |
| 3,729,057 | A | 4/1973 | Wemer |
| 3,746,330 | A | 7/1973 | Taciuk |
| 3,747,675 | A | 7/1973 | Brown |
| 3,760,894 | A | 9/1973 | Pitifer |
| 3,766,991 | A | 10/1973 | Brown |
| 3,776,320 | A | 12/1973 | Brown |
| 3,780,883 | A | 12/1973 | Brown |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swodoba, Jr. et al. |
| 3,848,684 | A | 11/1974 | West |
| 3,857,450 | A | 12/1974 | Guier |
| 3,870,114 | A | 3/1975 | Pulk et al. |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,934,660 | A | 1/1976 | Nelson |
| 3,945,444 | A | 3/1976 | Knudson |
| 3,947,009 | A | 3/1976 | Nelmark |
| 3,961,399 | A | 6/1976 | Boyadjieff |
| 3,964,552 | A | 6/1976 | Slator |
| 3,964,556 | A | 6/1976 | Gearhart et al. |

3,980,143 A 9/1976 Swartz et al.
4,049,066 A 9/1977 Richey
4,054,332 A 10/1977 Bryan, Jr.
4,054,426 A 10/1977 White
4,064,939 A 12/1977 Marquis
4,077,525 A 3/1978 Callegari et al.
4,082,144 A 4/1978 Marquis
4,083,405 A 4/1978 Shirley
4,085,808 A 4/1978 Kling
4,093,294 A 6/1978 Taylor
4,095,865 A 6/1978 Denison et al.
4,100,968 A 7/1978 Delano
4,100,981 A 7/1978 Chaffin
4,127,927 A 12/1978 Hauk et al.
4,133,396 A 1/1979 Tschirky
4,142,739 A 3/1979 Billingsley
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,202,225 A 5/1980 Sheldon et al.
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,401,000 A 8/1983 Kinzbach
4,407,378 A 10/1983 Thomas
4,408,669 A 10/1983 Wiredal
4,413,682 A 11/1983 Callihan et al.
4,427,063 A 1/1984 Skinner
4,428,421 A 1/1984 Rankin
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,577,687 A 3/1986 Lanmon, II
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,875,530 A 10/1989 Frink et al.
4,878,546 A 11/1989 Shaw et al.
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.

4,962,579 A 10/1990 Moyer et al.
4,962,819 A 10/1990 Bailey et al.
4,962,822 A 10/1990 Pascale
4,971,146 A 11/1990 Terrell
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,095,988 A 3/1992 Bode
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,207,128 A 5/1993 Albright
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,395 A 7/1995 Connell
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,806,589 A 9/1998 Lang
5,813,456 A 9/1998 Milner et al.
5,823,264 A 10/1998 Ringgenberg 5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,967,477 A 10/1999 Walmsley
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,334,376 B1 1/2002 Torres
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Clay
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,415,862 B1 7/2002 Mullins
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramos et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras

| | | | | |
|---|---|---|---|---|
| 6,634,430 | B2 | 10/2003 | Dawson et al. | |
| 6,637,526 | B2 | 10/2003 | Juhasz et al. | |
| 6,648,075 | B2 | 11/2003 | Badrak et al. | |
| 6,651,737 | B2 | 11/2003 | Bouligny | |
| 6,655,460 | B2 | 12/2003 | Bailey et al. | |
| 6,666,274 | B2 | 12/2003 | Hughes | |
| 6,668,684 | B2 | 12/2003 | Allen et al. | |
| 6,668,937 | B1 | 12/2003 | Murray | |
| 6,679,333 | B2 | 1/2004 | York et al. | |
| 6,688,394 | B1 | 2/2004 | Ayling | |
| 6,688,398 | B2 | 2/2004 | Pietras | |
| 6,691,801 | B2 | 2/2004 | Juhasz et al. | |
| 6,698,595 | B2 | 3/2004 | Norell et al. | |
| 6,702,040 | B1 | 3/2004 | Sensenig | |
| 6,708,769 | B2 | 3/2004 | Haugen et al. | |
| 6,715,430 | B2 | 4/2004 | Choi et al. | |
| 6,719,071 | B1 | 4/2004 | Moyes | |
| 6,725,924 | B2 | 4/2004 | Davidson et al. | |
| 6,725,938 | B1 | 4/2004 | Pietras | |
| 6,725,949 | B2 | 4/2004 | Seneviratne | |
| 6,732,822 | B2 | 5/2004 | Slack et al. | |
| 6,742,584 | B1 | 6/2004 | Appleton | |
| 6,742,596 | B2 | 6/2004 | Haugen | |
| 6,742,606 | B2 | 6/2004 | Metcalfe et al. | |
| 6,745,834 | B2 | 6/2004 | Davis et al. | |
| 6,752,211 | B2 | 6/2004 | Dewey et al. | |
| 6,776,233 | B2 | 8/2004 | Meehan | |
| 6,796,191 | B1 * | 9/2004 | Boyd | 73/862.321 |
| 6,832,656 | B2 | 12/2004 | Fournier, Jr. et al. | |
| 6,832,658 | B2 | 12/2004 | Keast | |
| 6,837,313 | B2 | 1/2005 | Hosie et al. | |
| 6,840,322 | B2 | 1/2005 | Haynes | |
| 6,848,517 | B2 | 2/2005 | Wardley | |
| 6,854,533 | B2 | 2/2005 | Galloway | |
| 6,857,486 | B2 | 2/2005 | Chitwood et al. | |
| 6,857,487 | B2 | 2/2005 | Galloway | |
| 6,868,906 | B1 | 3/2005 | Vail, III et al. | |
| 6,877,553 | B2 | 4/2005 | Cameron | |
| 6,889,772 | B2 | 5/2005 | Buytaert et al. | |
| 6,892,835 | B2 | 5/2005 | Shahin et al. | |
| 6,896,075 | B2 | 5/2005 | Haugen et al. | |
| 6,899,186 | B2 | 5/2005 | Galloway et al. | |
| 6,907,934 | B2 | 6/2005 | Kauffman | |
| 6,938,697 | B2 | 9/2005 | Haugen | |
| 6,976,298 | B1 | 12/2005 | Pietras | |
| 7,004,259 | B2 | 2/2006 | Pietras | |
| 7,011,160 | B2 * | 3/2006 | Boyd | 166/379 |
| 7,028,586 | B2 | 4/2006 | Robichaux | |
| 7,073,598 | B2 | 7/2006 | Haugen | |
| 7,090,021 | B2 | 8/2006 | Pietras | |
| 7,096,977 | B2 | 8/2006 | Juhasz et al. | |
| 7,100,698 | B2 | 9/2006 | Kracik et al. | |
| 7,100,699 | B2 | 9/2006 | Helms et al. | |
| 7,107,875 | B2 | 9/2006 | Haugen et al. | |
| 7,117,938 | B2 | 10/2006 | Hamilton et al. | |
| 7,131,497 | B2 * | 11/2006 | Helms et al. | 166/381 |
| 7,140,445 | B2 | 11/2006 | Shahin et al. | |
| 7,188,686 | B2 | 3/2007 | Folk et al. | |
| 7,213,656 | B2 | 5/2007 | Pietras | |
| 7,325,610 | B2 | 2/2008 | Giroux et al. | |
| 7,341,101 | B1 | 3/2008 | Moretz | |
| 2001/0042625 | A1 | 11/2001 | Appleton | |
| 2002/0029878 | A1 | 3/2002 | Victor | |
| 2002/0040787 | A1 | 4/2002 | Cook et al. | |
| 2002/0066556 | A1 | 6/2002 | Goode et al. | |
| 2002/0108748 | A1 | 8/2002 | Keyes | |
| 2002/0170720 | A1 | 11/2002 | Haugen | |
| 2002/0189883 | A1 | 12/2002 | Wardley | |
| 2003/0029641 | A1 | 2/2003 | Meehan | |
| 2003/0056991 | A1 | 3/2003 | Hahn et al. | |
| 2003/0070841 | A1 | 4/2003 | Merecka et al. | |
| 2003/0111267 | A1 | 6/2003 | Pia | |
| 2003/0141111 | A1 | 7/2003 | Pia | |
| 2003/0146023 | A1 | 8/2003 | Pia | |
| 2003/0155159 | A1 | 8/2003 | Slack et al. | |
| 2003/0164251 | A1 | 9/2003 | Tulloch | |
| 2003/0164276 | A1 | 9/2003 | Snider et al. | |
| 2003/0173073 | A1 | 9/2003 | Snider et al. | |
| 2003/0173090 | A1 | 9/2003 | Cook et al. | |
| 2003/0217865 | A1 | 11/2003 | Simpson et al. | |
| 2003/0221519 | A1 | 12/2003 | Haugen et al. | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0060697 | A1 | 4/2004 | Tilton et al. | |
| 2004/0069500 | A1 | 4/2004 | Haugen | |
| 2004/0108142 | A1 | 6/2004 | Vail, III | |
| 2004/0112646 | A1 | 6/2004 | Vail | |
| 2004/0118613 | A1 | 6/2004 | Vail | |
| 2004/0118614 | A1 | 6/2004 | Galloway et al. | |
| 2004/0122603 | A1 | 6/2004 | Galloway et al. | |
| 2004/0123984 | A1 | 7/2004 | Vail | |
| 2004/0124010 | A1 | 7/2004 | Galloway et al. | |
| 2004/0124011 | A1 | 7/2004 | Gledhill et al. | |
| 2004/0124015 | A1 | 7/2004 | Vaile et al. | |
| 2004/0129456 | A1 | 7/2004 | Vail | |
| 2004/0140128 | A1 | 7/2004 | Vail | |
| 2004/0144547 | A1 | 7/2004 | Koithan et al. | |
| 2004/0173358 | A1 | 9/2004 | Haugen | |
| 2004/0177973 | A1 * | 9/2004 | Helms et al. | 166/384 |
| 2004/0216892 | A1 | 11/2004 | Giroux et al. | |
| 2004/0216924 | A1 | 11/2004 | Pietras et al. | |
| 2004/0216925 | A1 | 11/2004 | Metcalfe et al. | |
| 2004/0221994 | A1 * | 11/2004 | Kauffman et al. | 166/380 |
| 2004/0221997 | A1 | 11/2004 | Giroux et al. | |
| 2004/0226751 | A1 | 11/2004 | McKay et al. | |
| 2004/0244992 | A1 | 12/2004 | Carter et al. | |
| 2004/0245020 | A1 | 12/2004 | Giroux et al. | |
| 2004/0251025 | A1 | 12/2004 | Giroux et al. | |
| 2004/0251050 | A1 | 12/2004 | Shahin et al. | |
| 2004/0251055 | A1 | 12/2004 | Shahin et al. | |
| 2004/0262013 | A1 | 12/2004 | Tilton et al. | |
| 2005/0000691 | A1 | 1/2005 | Giroux et al. | |
| 2005/0051343 | A1 | 3/2005 | Pietras et al. | |
| 2005/0096846 | A1 | 5/2005 | Koithan et al. | |
| 2005/0098352 | A1 | 5/2005 | Beierbach et al. | |
| 2006/0000600 | A1 * | 1/2006 | Pietras | 166/77.52 |
| 2006/0124353 | A1 | 6/2006 | Juhasz et al. | |
| 2006/0180315 | A1 | 8/2006 | Shahin et al. | |
| 2007/0000668 | A1 | 1/2007 | Christensen | |
| 2007/0095544 | A1 * | 5/2007 | Boyd | 166/385 |
| 2007/0158078 | A1 | 7/2007 | Boyd | |
| 2007/0199718 | A1 | 8/2007 | Boyd | |
| 2008/0059073 | A1 * | 3/2008 | Giroux et al. | 702/9 |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |

| | | |
|---|---|---|
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 205 628 | 5/2002 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 2 389 130 | 12/2003 |
| JP | 2001-173349 | 6/2001 |
| WO | WO 90-06418 | 6/1990 |
| WO | WO 91-16520 | 10/1991 |
| WO | WO 92-01139 | 1/1992 |
| WO | WO 92-18743 | 10/1992 |
| WO | WO 92-20899 | 11/1992 |
| WO | WO 93-07358 | 4/1993 |
| WO | WO 93-24728 | 12/1993 |
| WO | WO 95-10686 | 4/1995 |
| WO | WO 96-18799 | 6/1996 |
| WO | WO 96-28635 | 9/1996 |
| WO | WO 96/30624 | * 10/1996 |
| WO | WO 97-05360 | 2/1997 |
| WO | WO 97-08418 | 3/1997 |
| WO | WO 98/01651 | 1/1998 |
| WO | WO 98-05844 | 2/1998 |
| WO | WO 98-09053 | 3/1998 |
| WO | WO 98-11322 | 3/1998 |
| WO | WO 98-32948 | 7/1998 |
| WO | WO 98-55730 | 12/1998 |
| WO | WO 99-04135 | 1/1999 |
| WO | WO 99-11902 | 3/1999 |
| WO | WO 99-23354 | 5/1999 |
| WO | WO 99-24689 | 5/1999 |
| WO | WO 99-35368 | 7/1999 |
| WO | WO 99-37881 | 7/1999 |
| WO | WO 99-41485 | 8/1999 |
| WO | WO 99-50528 | 10/1999 |
| WO | WO 99-58810 | 11/1999 |
| WO | WO 99-64713 | 12/1999 |
| WO | WO 00/04269 | 1/2000 |
| WO | WO 00-05483 | 2/2000 |
| WO | WO 00-08293 | 2/2000 |
| WO | WO 00/09853 | 2/2000 |
| WO | WO 00-11309 | 3/2000 |
| WO | WO 00-11310 | 3/2000 |
| WO | WO 00-11311 | 3/2000 |
| WO | WO 00-28188 | 5/2000 |
| WO | WO 00-37766 | 6/2000 |
| WO | WO 00-37771 | 6/2000 |
| WO | WO 00-39429 | 7/2000 |
| WO | WO 00-39430 | 7/2000 |
| WO | WO 00/41487 | 7/2000 |
| WO | WO 00-46484 | 8/2000 |
| WO | WO 00-50730 | 8/2000 |
| WO | WO 00/52297 | 9/2000 |
| WO | WO 00-66879 | 11/2000 |
| WO | WO 01-12946 | 2/2001 |
| WO | WO 01/33033 | 5/2001 |
| WO | WO 01-46550 | 6/2001 |
| WO | WO 01/59253 | 8/2001 |
| WO | WO 01-79650 | 10/2001 |
| WO | WO 01/79652 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02-44601 | 6/2002 |
| WO | WO 02-081863 | 10/2002 |
| WO | WO 02-086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |
| WO | WO 2004/079155 | 9/2004 |
| WO | WO 2005/090740 | 9/2005 |

OTHER PUBLICATIONS

Bickford, et al, Casing Drilling Rig Selection for Stratton Field, Texas, World Oil Magazine, Vo. 226. No. 3 (Mar. 2005) based on presented paper at 2004 Casing while Drilling Technical Conference, Houston, Mar. 30-31, 2004.

Alexander Sas-Jaworsky and J. G. Williams, Development of Composite Coiled Tubing For Oilfield Services, SPE 26535, Society of Petroleum Engineers, Inc., 1993.

A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.

G. F. Boykin, The Role of A Worldwide Drilling Organization and the Road to the Future, SPE/IADC 37360, 1997.

M. S. Fuller, M. Littler, and I. Pollock, Innovative Way to Cement a Liner Utitizing a New Inner String Liner Cementing Process, 1998.

Helio Santos, Consequences and Relevance of Drillstring Vibration on Wellbore Stability, SPE/IADC 52820, 1999.

Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.

C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properties, IBP 27500, Brazilian Petroleum Institute—IBP, 2000.
Coiled Tubing Handbook, World Oil, Gulf Publishing Company, 1993.
U.S. Appl. No. 10/189,570, filed Jun. 6, 2002.
U.S. Appl. No. 10/618,093, filed Jul. 11, 2003.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. (1998), pp. 124-130.
"First Success with Casing-Drilling" Word Oil, Feb. (1999), pp. 25.
Dean E. Gaddy, Editor, "Russia Shares Technical Know-How with U.S." Oil & Gas Journal, Mar. (1999), pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Stop Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001 pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 6 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Ppaer 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System,"SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations in Lobo Trend," paper WOCD-0306-04, World Oil Casing Drilling Technical Conference, Mar. 6-7, 2003, pp. 1-13.

McKay, et al., "New Developments In The Technology Of Drilling With Casing: Utilizing A Displceable DrillShoe Tool," Paper WOCD-0306-05, World Oil Casing Drilling Technical Conference, Mar. 6-7, 2003, pp. 1-11.

Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.

Vincent, et al., "Liner And Casing Drilling—Case Histories And Technology," Paper WOCD-0307-02. World Oil Casing Drilling Technical Conference, Mar. 6-7, 2003, pp. 1-20.

Maute, "Electrical Logging: State-of-the Art," The Log Analyst, May-Jun. 1992, pp. 206-227.

Tessari, et al., "Retrievable Tools Provide Flexibility for Casing Drilling," Paper No. WOCD-0306-01, World Oil Casing Drilling Technical Conference, 2003, pp. 1-11.

Evans, et al., "Development And Testing Of An Economical Casing Connection For Use In Drilling Operations," paper WOCD-0306-03, World Oil Casing Drilling Technical Conference, Mar. 6-7, 2003, pp. 1-10.

Detlef Hahn, Friedhelm Makohl, and Larry Watkins, Casing-While Drilling System Reduces Hole Collapse Risks, Offshore, pp. 54, 56, and 59, Feb. 1998.

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Valves Wellhead Equipment Saftey Systems, W-K-M Division, ACF Industries, Catalog 80, 1980, 5 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

U.K. Search Report, U.K. Application No. 0515813.4, dated Oct. 26, 2005.

Canadian Office Action, Application No. 2,514,136, dated Jan. 21, 2008.

* cited by examiner

APPARATUS AND METHODS OF SETTING AND RETRIEVING CASING WITH DRILLING LATCH AND BOTTOM HOLE ASSEMBLY

CROSS-REFERENCE TO RELATED APPLICATIONS

This application claims benefit of U.S. Provisional Patent Application Ser. No. 60/592,708, filed on Jul. 30, 2004, which application is herein incorporated by reference in its entirety.

BACKGROUND OF THE INVENTION

1. Field of the Invention

The present invention relates to methods and apparatus for drilling with top drive systems. Particularly, the invention relates to methods and apparatus for retrieving a downhole tool through a top drive system. More particularly still, the invention relates to running a wireline through the top drive system to retrieve the downhole tool and running a wireline access below the top drive system. The invention also relates to performing a cementing operation with the top drive system.

2. Description of the Related Art

One conventional method to complete a well includes drilling to a first designated depth with a drill bit on a drill string. Then, the drill string is removed, and a first string of casing is run into the wellbore and set in the drilled out portion of the wellbore. Cement is circulated into the annulus behind the casing string and allowed to cure. Next, the well is drilled to a second designated depth, and a second string of casing, or liner, is run into the drilled out portion of the wellbore. The second string is set at a depth such that the upper portion of the second string of casing overlaps the lower portion of the first string of casing. The second string is then fixed, or "hung" off of the existing casing by the use of slips which utilize slip members and cones to wedgingly fix the second string of casing in the wellbore. The second casing string is then cemented. This process is typically repeated with additional casing strings until the well has been drilled to a desired depth. Therefore, two run-ins into the wellbore are required per casing string to set the casing into the wellbore.

As more casing strings are set in the wellbore, the casing strings become progressively smaller in diameter in order to fit within the previous casing string. In a drilling operation, the drill bit for drilling to the next predetermined depth must thus become progressively smaller as the diameter of each casing string decreases in order to fit within the previous casing string. Therefore, multiple drill bits of different sizes are ordinarily necessary for drilling in well completion operations.

Another method of performing well completion operations involves drilling with casing, as opposed to the first method of drilling and then setting the casing. In this method, the casing string is run into the wellbore along with a drill bit for drilling the subsequent, smaller diameter hole located in the interior of the existing casing string. The drill bit is operated by rotation of the drill string from the surface of the wellbore, and/or rotation of a downhole motor. Once the borehole is formed, the attached casing string may be cemented in the borehole. The drill bit is either removed or destroyed by the drilling of a subsequent borehole. The subsequent borehole may be drilled by a second working string comprising a second drill bit disposed at the end of a second casing that is of sufficient size to line the wall of the borehole formed. The second drill bit should be smaller than the first drill bit so that it fits within the existing casing string. In this respect, this method typically requires only one run into the wellbore per casing string that is set into the wellbore.

In some operations, the drill shoe disposed at the lower end of the casing is designed to be drilled through by the subsequent casing string. However, retrievable drill bits and drilling assemblies have been developed to reduce the cost of the drilling operation. These drilling assemblies are equipped with a latch that is operable to selectively attach the drilling assembly to the casing. In this respect, the drilling assembly may be preserved for subsequent drilling operations.

It is known in the industry to use top drive systems to rotate the casing string and the drill shoe to form a borehole. Top drive systems are equipped with a motor to provide torque for rotating the drilling string. Most existing top drives use a threaded crossover adapter to connect to the casing. This is because the quill of the top drive is not sized to connect with the threads of the casing.

More recently, top drive adapters has been developed to facilitate the casing running process. Top drive adapters that grip the external portion of the casing are generally known as torque heads, while adapters that grip the internal portion of the casing are generally known as spears. An exemplary torque head is disclosed in U.S. patent application Ser. No. 10/850,347, entitled Casing Running Head, which application was filed on May 20, 2004 by the same inventor of the present application. An exemplary spear is disclosed in U.S. Patent Application Publication No. 2005/0051343, by Pietras, et al. These applications are assigned to the assignee of the present application and are herein incorporated by reference in their entirety.

One of the challenges of drilling with casing is the retrieval of the drilling assembly. For example, the drilling operation may be temporarily stopped to repair or replace the drilling assembly. In such instances, a wireline may be used to retrieve the latch and the drilling assembly. However, many existing top drives are not equipped with an access for the insertion or removal of the wireline, thereby making the run-in of the wireline more difficult and time consuming. Additionally, during the temporary stoppage to retrieve the drilling assembly, fluid circulation and casing movement is also typically stopped. As a result, the casing in the wellbore may become stuck, thereby hindering the rotation and advancement of the casing upon restart of the drilling operation.

There is a need, therefore, for methods and apparatus for retrieving the drilling assembly during and after drilling operations. There is also a need for apparatus and method for fluid circulation during the drilling assembly retrieval process. There is a further need for apparatus and methods for running a wireline while drilling with casing using a top drive. There is yet a further need for methods and apparatus for accessing the interior of a casing string connected to a top drive.

SUMMARY OF THE INVENTION

In one embodiment, a top drive system for forming a wellbore is provided with an access tool to retrieve a downhole tool. The top drive system for drilling with casing comprises a top drive; a top drive adapter for gripping the casing, the top drive adapter operatively connected to the top drive; and an access tool operatively connected to the top drive and adapted for accessing a fluid passage of the top drive system. In one embodiment, the top drive system is used for drilling with casing operations.

In another embodiment, a method for retrieving a downhole tool through a tubular coupled to a top drive adapter of a top drive system is provided. The method comprises coupling an access tool to the top drive system, the access tool adapted to provide access to a fluid path in the top drive system and inserting a conveying member into the fluid path through the access tool. The method also includes coupling the conveying member to the downhole tool and retrieving the downhole tool. In another embodiment, the method further comprises reciprocating the tubular. In yet another embodiment, the method further comprises circulating fluid to the tubular. Preferably, the tubular comprises a casing.

In another embodiment still, a method for releasing an actuating device during drilling using a top drive system is provided. The method comprises providing the top drive system with a top drive, a top drive adapter, and a launching tool, the launching tool retaining the actuating device, and operatively coupling the top drive, the top drive adapter, and the launching tool. The method also includes gripping a tubular using the top drive adapter and actuating the launching tool to release the actuating device.

In another embodiment still, a method for performing a cementing operation using a top drive system is provided. The method comprises providing the top drive system with a top drive, a top drive adapter, and a cementing tool and operatively coupling the top drive, the top drive adapter, and the cementing tool. The method also comprises gripping the casing using the top drive adapter and supplying a cementing fluid through the cementing tool.

BRIEF DESCRIPTION OF THE DRAWINGS

So that the manner in which the above recited features and other features contemplated and claimed herein are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In one embodiment, a top drive system for drilling includes a top drive adapter for gripping and rotating the casing and a top drive access tool. The top drive access tool is adapted to allow access into the various components connected to the top drive. The access tool is equipped with a sealing member to prevent leakage and hold pressure during fluid circulation. In another embodiment, the access tool is adapted to allow the top drive to reciprocate the casing during wireline work.

Figure 1:
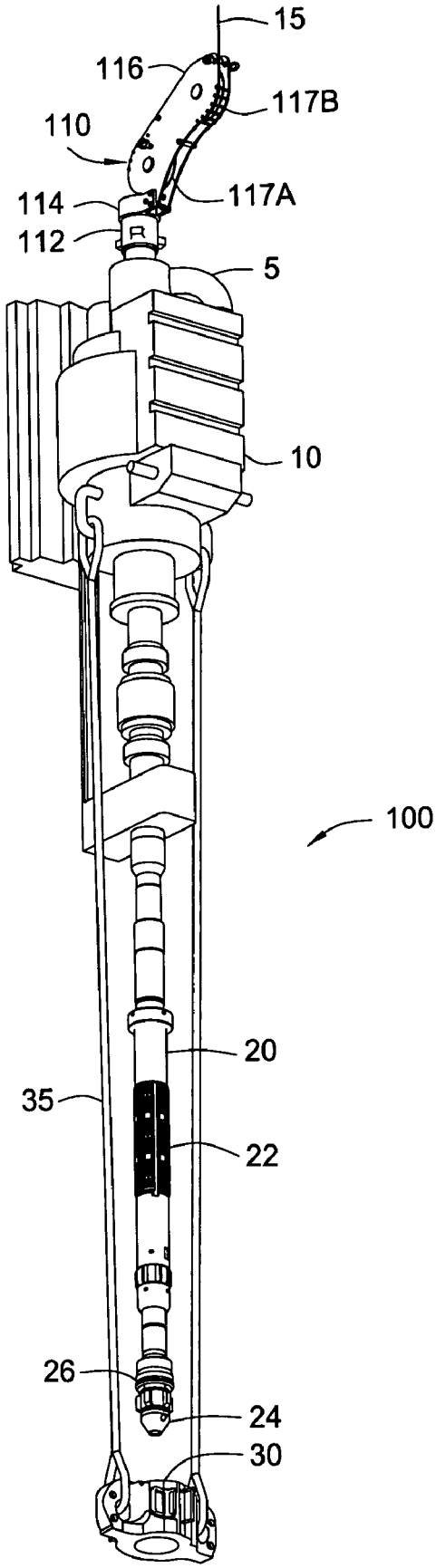
FIG. 1 shows an exemplary embodiment of a top drive system having an access tool.

FIG. 1 shows an embodiment of a top drive system 100 fitted with a top drive access tool 110. As shown, the system 100 includes a spear type top drive adapter 20 and a top drive 10 for energizing the spear 20. The spear 20 includes radially actuatable gripping members 22 for engaging the inner diameter of the casing. Although a mechanically actuated spear is preferred, spears actuated using hydraulics, pneumatics, or electric are equally suitable. The lower portion of the spear 20 includes a valve 24 for supplying fluid and a seal member 26 to prevent leakage. Fluids such as drilling mud may be introduced into the top drive system 100 through a fluid supply line 5 disposed at an upper portion of the top drive 10. An elevator 30 is suspended below the top drive 10 by a pair of bails 35 coupled to the top drive 10. It must be noted that in addition to the spear, other types of top drive adapters such as a torque head are also contemplated.

In one embodiment, the top drive access tool 110 is coupled to the upper portion of the top drive 10. The access tool 110 is adapted to allow wireline access into the interior of the casing in order to perform wireline operations such as retrieval of the drilling assembly or the latch attached to a drilling assembly. As shown in FIG. 1, the access tool 110 includes a connection member 112 for connecting to the top drive 10. The connection member 112 includes a bore to receive the wireline 15 and a pack-off assembly 114 for preventing leakage. The pack-off assembly 114 may comprise an elastomeric seal element and sized to accommodate different wireline sizes. A sheave assembly 116 is connected to the connection member 112. The sheave assembly 116 facilitates and supports the wireline 15 for entry into the top drive 10. Preferably, the sheave assembly 116 is arranged such that it does not obstruct the operation of the traveling block, which is typically used to translate the top drive 10. In one embodiment, the sheave assembly 116 includes two wheels 117A, 117B adapted for operation with the top drive 10. The wheels 117A, 117B may include grooves disposed around the circumference of the wheels 117A, 117B for receiving the wireline 15. The wireline 15 may be routed around the wheels 117A, 117B of the sheave assembly 116 to avoid the traveling block and directed into the pack-off assembly 114 and the connection member 112. In another embodiment, the fluid supply line 5 may be connected to the connection member 112 of the access tool 110. A suitable access tool is disclosed in U.S. Pat. No. 5,735,351 issued to Helms, which patent is herein incorporated by reference in its entirety. During wireline operations, the top drive system 100 provided in FIG. 1 may be operated to reciprocate the casing in the wellbore and circulate fluid through the casing. It is believed that these operations will reduce the likelihood of the casing sticking to the wellbore. In addition to a wireline 15, the embodiments described herein are equally applicable to a cable or other types of conveying members known to a person of ordinary skill in the art.

Figure 2:
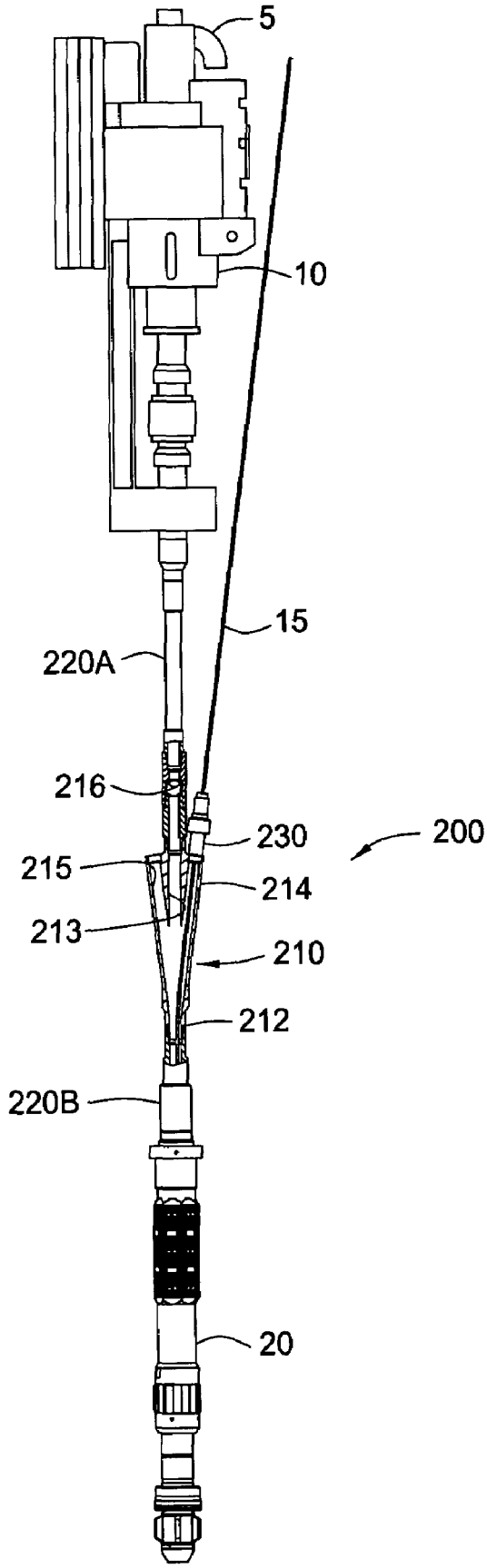
FIG. 2 shows an alternative top drive system having another embodiment of an access tool.

FIG. 2 illustrates another embodiment of a top drive system 200 equipped with an access tool 210. Similar to the embodiment shown in FIG. 1, the top drive system 200 includes a spear type top drive adapter 20 coupled to the top drive 10. However, the elevator and the bails have been removed for clarity. In this embodiment, the access tool 210 is disposed between the top drive 10 and the spear 20. The access tool 210 defines a tubular having a main portion 212 and one or more side portions 214 attached thereto. The upper end of the main portion 212 is connected to the top drive 10, and the lower end is connected to the spear 20. Extension subs or tubulars 220A, 220B may be used to couple the access tool 210 to the top drive 10 or the spear 20. A central passage 213 in the main portion 212 is adapted for fluid communication with the top drive 10 and the spear 20. The side entry portions 214 have side entry passages 215 in fluid communication with the central passage 213. In the embodiment shown, the access tool 210 includes two side portions 214. Each side portion 214 may include a pack-off assembly 230 to prevent leakage and hold pressure. In this respect, the pack-off assembly 230 also functions as a blow out preventer. In operation, the wireline 15 accesses the casing through one of the side portions 214. Additionally, the access tool 210 allows the top drive system 200 to reciprocate the casing and circulate drilling fluid using the spear 20 during wireline operation. Fluid may be supplied to the top drive 10 through the fluid supply line 5. In another embodiment, the access tool 210 may optionally include a valve 216 to isolate the fluid in the top drive 10 from fluid supplied through one of the side entry passages 215. Exemplary valves include a ball valve, one-way valves, or any suitable valve known to a person of ordinary skill in the art.

Figure 3:
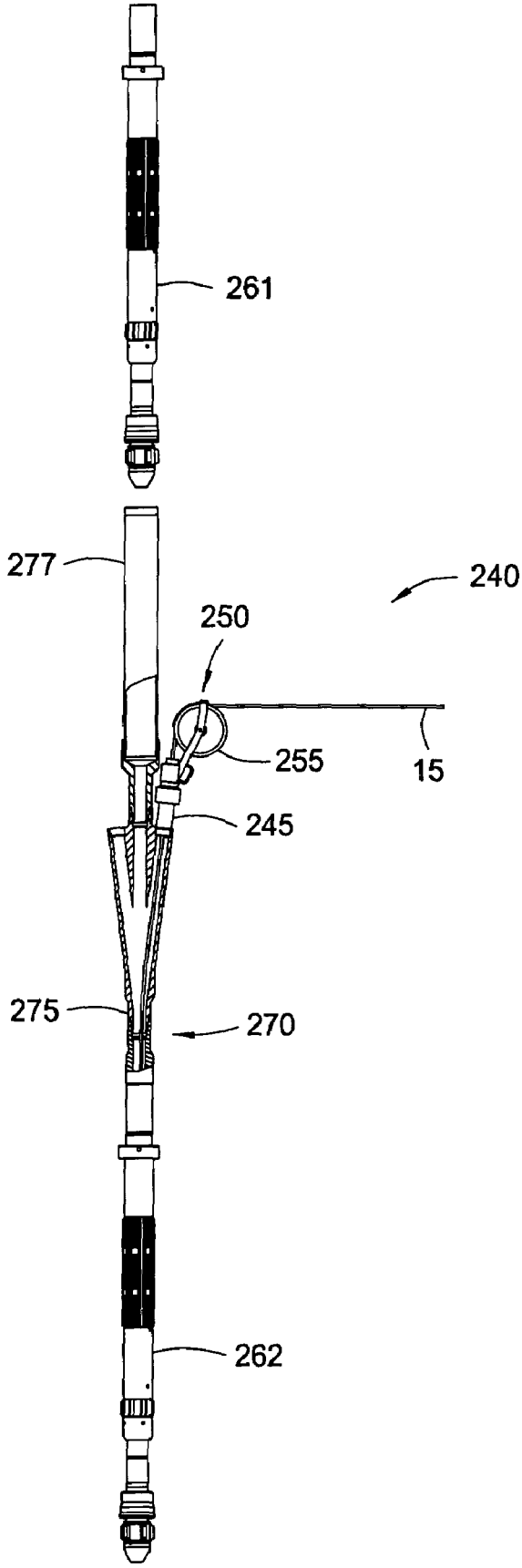
FIG. 3 shows another embodiment of an access tool.

In another embodiment, the top drive system 240 may include a sheave assembly 250 attached to the pack-off assembly 245, as illustrated in FIG. 3. The sheave assembly 250 may include a sheave wheel 255 to reduce the friction experienced by the wireline 15. In yet another embodiment, the top drive system 240 may include two spears 261, 262, two torque heads, or combinations thereof to increase the speed of modifying the top drive 10 for wireline operation. As shown, a first spear 261 is connected to the top drive 10 and initially retains a casing string for drilling operations. When wireline operation is desired, the first spear 261 may release the casing and retain an access assembly 270 having an access tool 275, an extension tubular 277, and a spear 262. The spear 262 of the access assembly 270 can now be used to retain the casing string and reciprocate the casing string and/or circulate fluid during the wireline operation. After completion of the wireline operation, the access assembly 270 may be quickly removed by disengagement of the spears 261, 262. It should be appreciated the spears may be torque heads or a combination of spears and torque heads.

Figure 4:
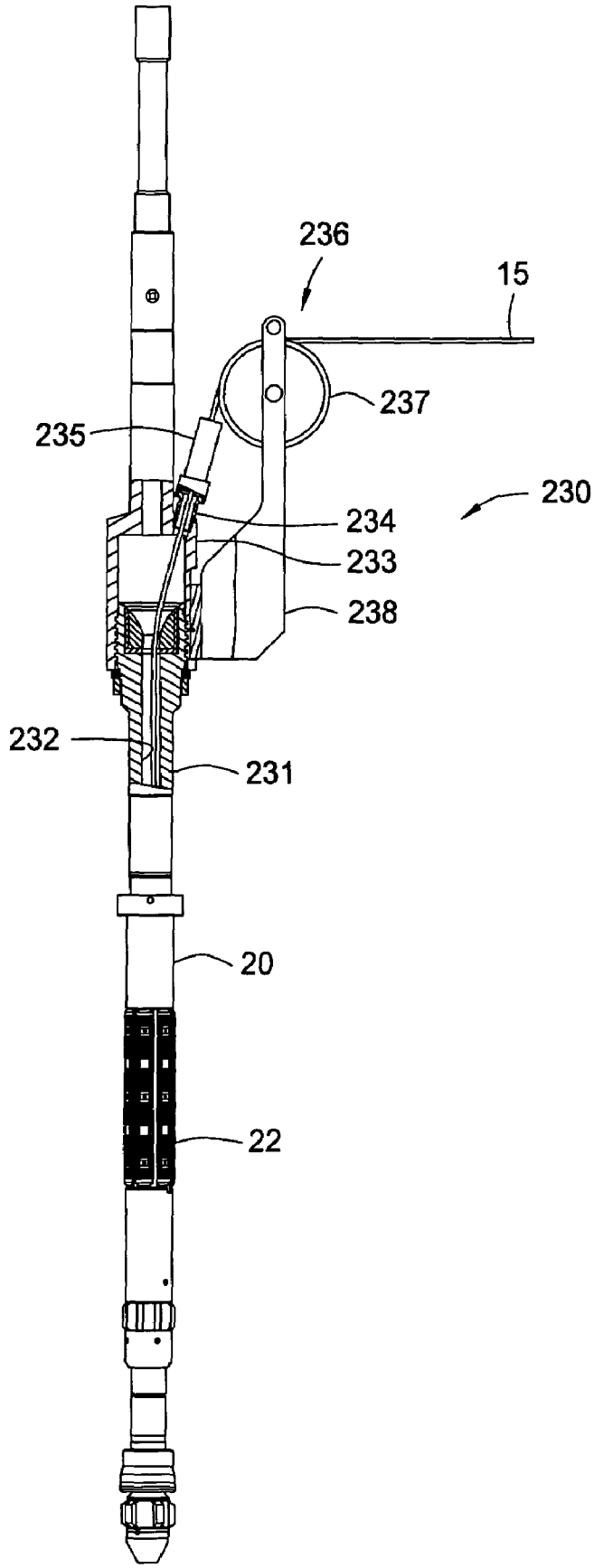
FIG. 4 shows yet another embodiment of an access tool.

FIG. 4 is a partial cross-sectional view of another embodiment of the access system 230. The access system 230 is attached to a spear 20 having gripping members 22 adapted to retain a casing. The access system 230 includes a main portion 231 and a side portion 233. It can be seen that the side entry passage 234 is in fluid communication with the main passage 232. The side portion 233 is equipped with a pack-off assembly 235 and a sheave assembly 236. The sheave assembly 236 includes a sheave wheel 237 supported on a support arm 238 that is attached to the main portion 231. As shown, a cable 15 has been inserted through the pack-off assembly 235, the side entry passage 234, the main passage 232, and the spear 20.

Figure 5:
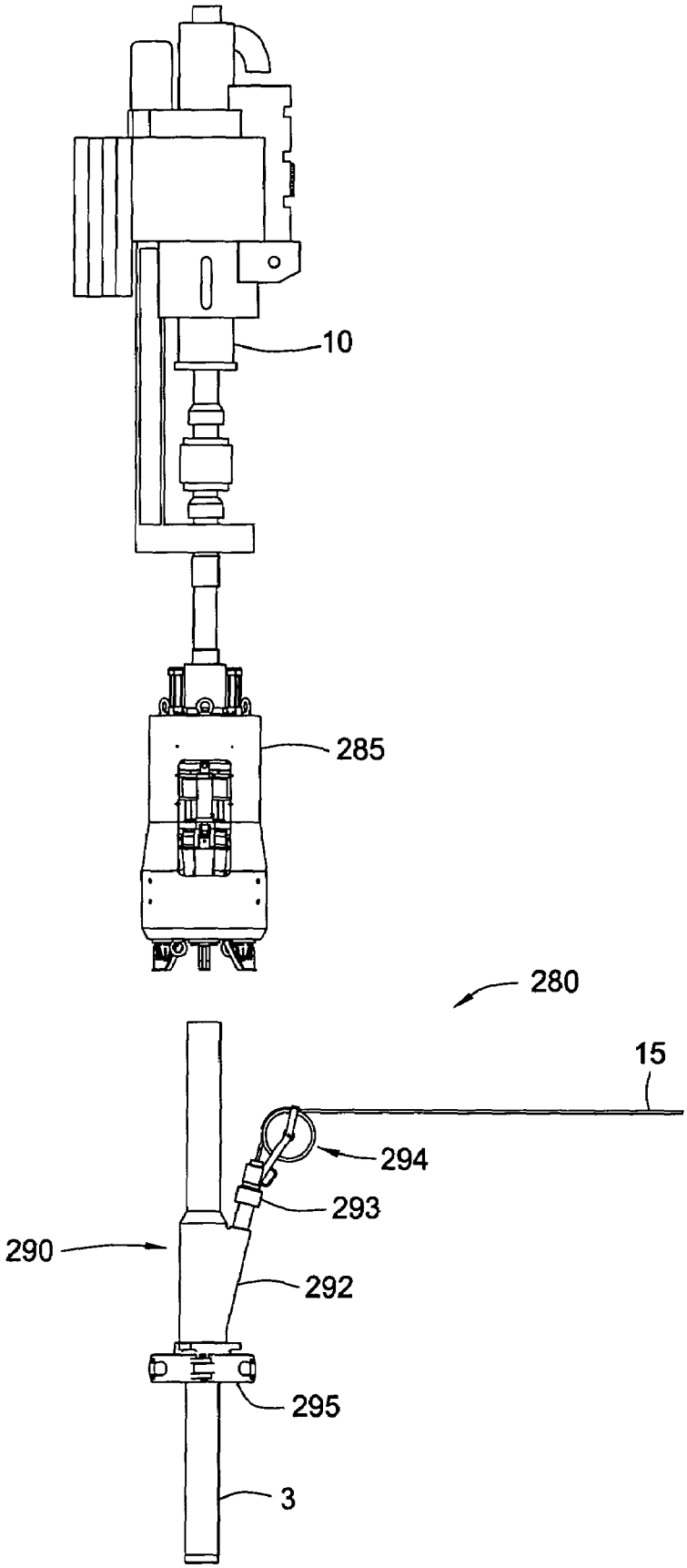
FIG. 5 shows an alternative top drive system equipped with yet another embodiment of an access tool.

In yet another embodiment, a top drive system 280 may include an external gripping top drive adapter 285 for use with the top drive 10 and the access tool 290, as illustrated in FIG. 5. An exemplary top drive adapter is disclosed in U.S. patent application Ser. No. 10/850,347, entitled Casing Running Head, filed on May 20, 2004 by Bernd-Georg Pietras. The application is assigned to the same assignee as the present application and is herein incorporated by reference in its entirety. In this embodiment, the top drive adapter 285, also known as a torque head, may release the casing and retain the access tool 290. The access tool 290, as shown, is adapted with one side entry portion 292 having a pack-off assembly 293 and a sheave assembly 294. A casing collar clamp 295 attached to the access tool 290 is used to retain the casing string 3. It must be noted that other types of casing retaining devices such as an elevator or a cross-over adapter may be used instead of the casing collar clamp, as is known to a person of ordinary skill in the art.

Figure 6:
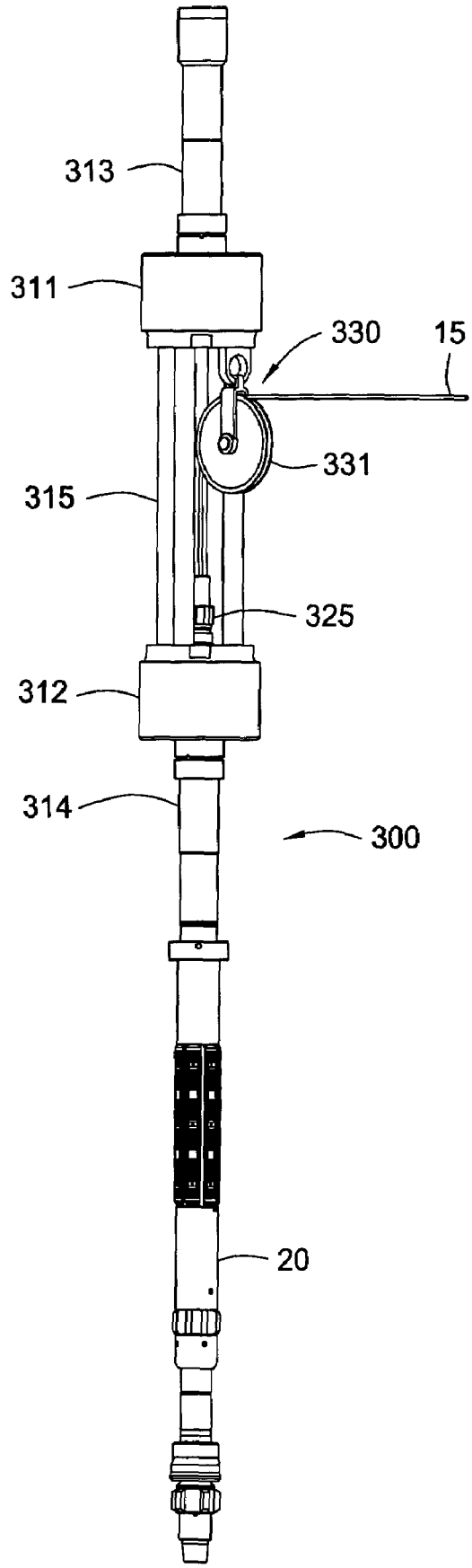
FIG. 6 shows yet another embodiment of an access tool.
Figure 6A:
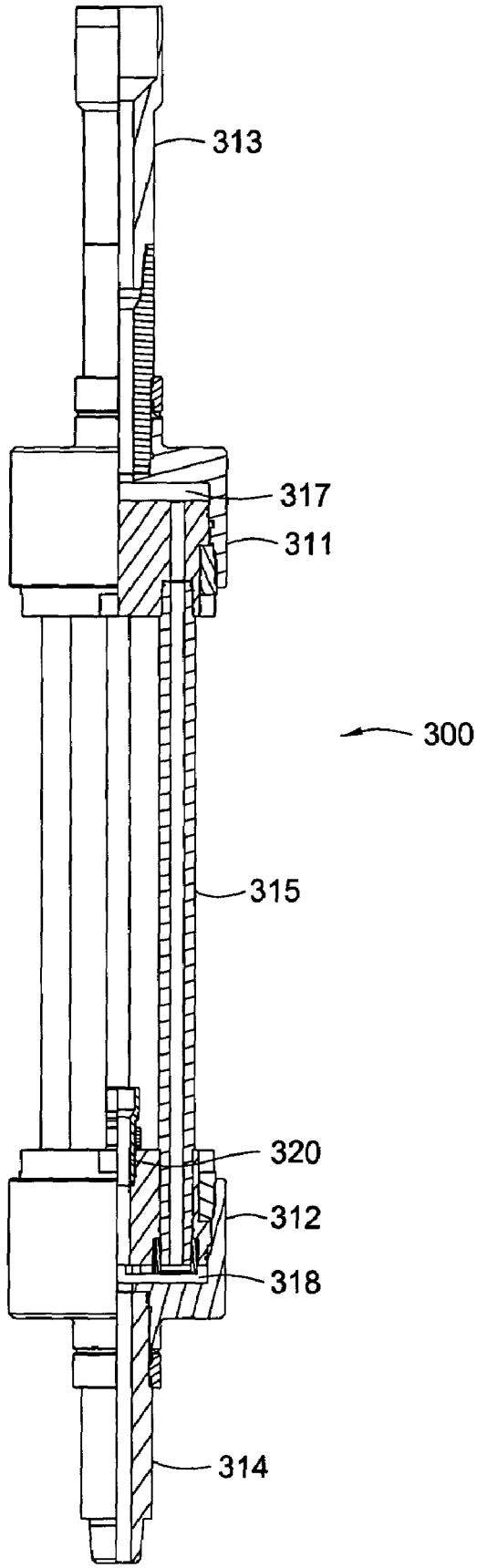
FIG. 6A is a partial cross-sectional view of the access tool of FIG. 6.

FIG. 6 illustrates another embodiment of the access system 300. The access system 300 includes an upper manifold 311 and a lower manifold 312 connected by one or more flow subs 315. Each manifold 311, 312 includes a connection sub 313, 314 for coupling to the top drive 10 or the spear 20. FIG. 6A is a cross-section view of the access system 300. Fluid flowing through the upper connection sub 313 is directed toward a manifold chamber 317 in the upper manifold 311, where it is then separated into the four flow subs 315. Fluid in the flow subs 315 aggregates in a chamber 318 of the lower manifold 312 and exits through the lower connection sub 314, which channels the fluid to the spear 20. Although the embodiment is described with four flow subs, it is contemplated any number of flow subs may be used.

The lower manifold 312 includes an access opening 320 for insertion of the wireline 15. As shown, the opening 320 is fitted with a pack-off assembly 325 to prevent leakage and hold pressure. Preferably, the opening 320 is in axial alignment with the spear 20 and the casing 3. In this respect, the wireline 15 is centered over the hoisting load, thereby minimizing wireline wear, as shown in FIG. 6. The access system 300 may also include a sheave assembly 330 to facilitate the axial alignment of the wireline 15 with the opening 320. The sheave wheel 331 is positioned with respect to the upper manifold 311 such that the wireline 15 routed therethrough is substantially centered with the opening 320.

In another embodiment, a swivel may be disposed between the access system 300 and the spear 20. An exemplary swivel may comprise a bearing system. The addition of the swivel allows the casing string 3 to be rotated while the sheave assembly 330 remains stationary. The casing string 3 may be rotated using a kelly, a rotary table, or any suitable manner known to a person of ordinary skill in the art.

Figure 7:
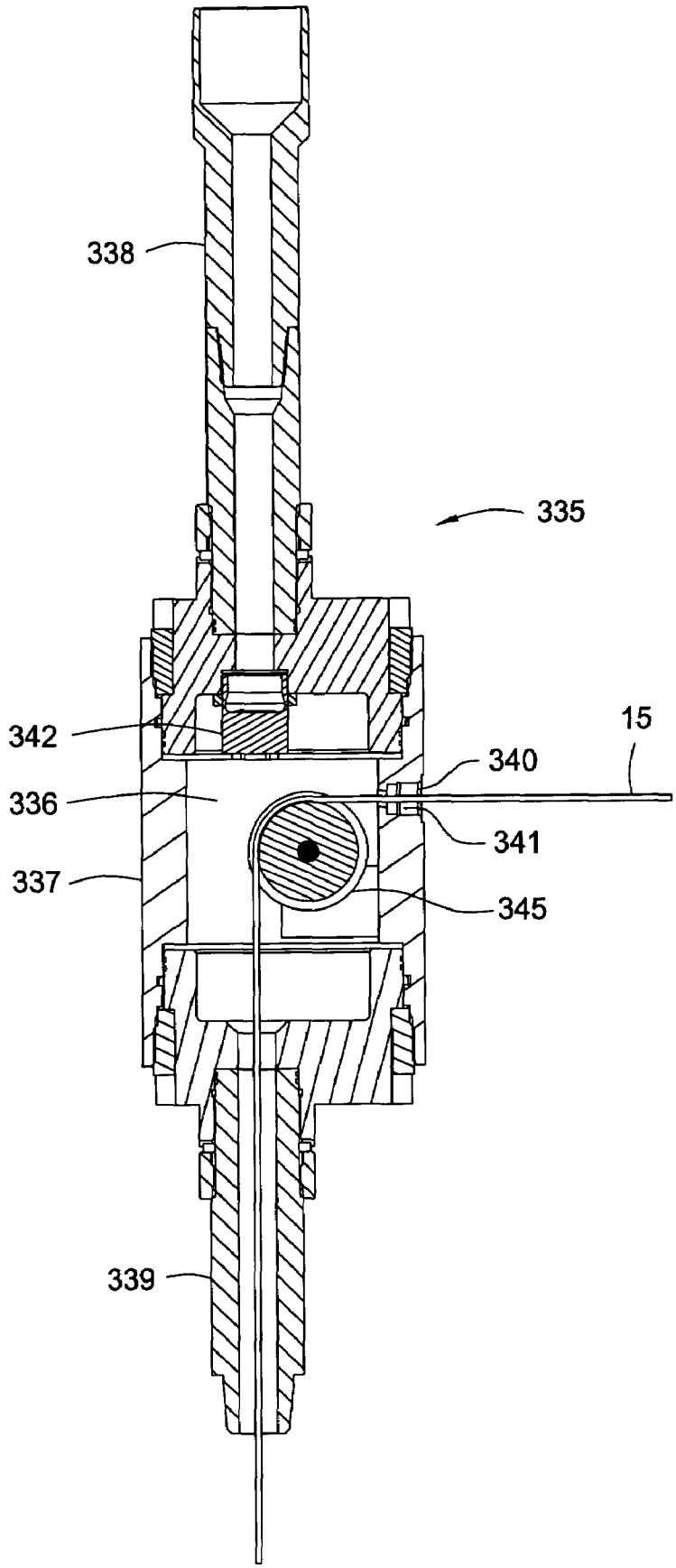
FIG. 7 is a partial cross-sectional view of another embodiment of an access tool.

FIG. 7 illustrates another embodiment of an access tool 335. The access tool 335 includes a housing 337 having an upper connection sub 338 and a lower connection sub 339. The connection subs 338, 339 are adapted for fluid communication with a chamber 336 in the housing 337. The housing 337 includes an access port 340 for receiving the wireline 15. The access port 340 is equipped with a pack-off assembly 341 to prevent fluid leakage and hold pressure. In one embodiment, a sheave assembly 345 is installed in the chamber 336 to facilitate movement of the wireline 15. Preferably, the sheave assembly 345 is positioned such that the wireline 15 is aligned with the lower connection sub 339. In another embodiment, a fluid diverter 342 may be installed at the upper portion of the chamber 336 to divert the fluid entering the chamber 336 from the upper connection sub 338. The fluid diverter 342 may be adapted to diffuse the fluid flow, redirect the fluid flow, or combinations thereof.

Figure 8:
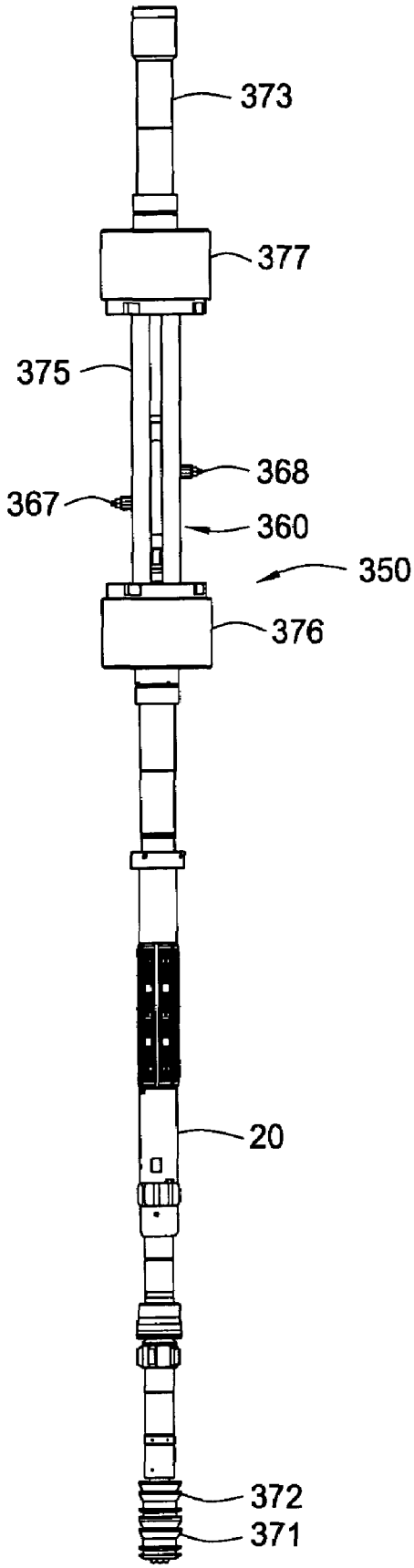
FIG. 8 shows an embodiment of an access tool having a launching tool.
Figure 8A:
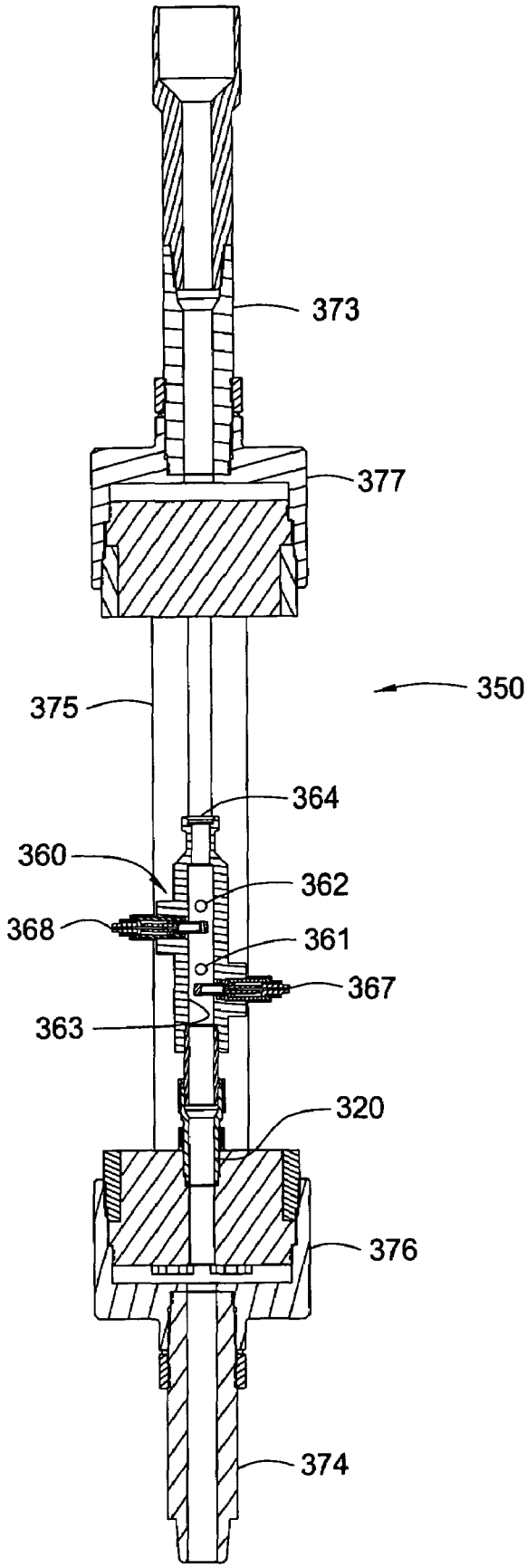
FIG. 8A is a cross-sectional view of the access tool of FIG. 8.

In another embodiment, the top drive system 350 may be equipped with a tool 360 for releasing downhole actuating devices such as a ball or dart. In one embodiment, the launching or releasing tool 360 may be used to selectively actuate or release a plug 371, 372 during a cementing operation, as shown in FIGS. 8-8A. FIG. 8A is a cross-sectional view of the access tool 350 with the launching tool 360. The access tool 350 is similar to the access tool 300 of FIG. 6. As shown, the access tool 350 includes an upper manifold 377 and a lower manifold 376 connected by one or more flow subs 375. Each manifold 377, 376 includes a connection sub 373, 374 for coupling to the top drive 10 or the spear 20. In FIG. 8A, the launching tool 360 has replaced the packing-off assembly 325 shown in FIG. 6. The launching tool 360 is adapted to selectively drop the two balls 361, 362 downhole, thereby causing the release of the two plugs 371, 372 attached to a lower portion of the spear 20. The launching tool 360 includes a bore 363 in substantial alignment with the bore of the connection sub 374. The balls 361, 362 are separately retained in the bore by a respective releasing pin 367, 368. Fluids, such as cement, may be pumped through upper portion 364 of the launching tool 360 and selectively around the balls 361, 362. Actuation of the releasing pin 367, 368 will cause these balls 361, 362, aided by the fluid pumped behind, to be launched into the flow stream to release the plugs 371, 372. It must be noted that any suitable launching tool known to a person of ordinary skill in the art may also be adapted for use with the access tool. In addition, the components may be arranged in any suitable manner. For example, the launching tool 360 may be disposed between the access tool 350 and the spear 20. In this respect, fluid exiting the access tool 350 will flow through the launching tool 360 before entering the spear 20.

In operation, the first release pin 367 is deactivated to allow the first ball 361 to drop into the lower manifold 376 and travel downward to the spear 20. The first ball 361 is preferably positioned between the drilling fluid and the cement. The first ball 361 will land and seat in the first, or lower, plug 371 and block off fluid flow downhole. Fluid pressure build up will cause the first plug 371 to release downhole. As it travels downward, the first plug 371 functions as a buffer between the drilling fluid, which is ahead of the first plug 371, and the cement, which is behind the first plug 371. When sufficient cement has been introduced, the second release pin 368 is deactivated to drop the second ball 362 from the launching tool 360. The second ball 362 will travel through the bore and land in the second, or upper, plug 372. Seating of the ball 362 will block off fluid flow and cause an increase in fluid pressure. When a predetermined fluid pressure is reached, the second plug 372 will be released downhole. The second plug 372 will separate the cement, which is in front of the second plug 372, from the drilling fluid or spacer fluid, which is behind the second plug 372.

In another embodiment, the plugs may be coupled to the casing string instead of the top drive adapter. As shown in FIG. 8C, a plug 400 is provided with a retaining member 410 for selective attachment to a casing string 3. Preferably, the retaining member 410 attaches to the casing string 3 at a location where two casing sections 403, 404 are threadedly connected to a coupling 405. Particularly, the retaining member 410 includes a key 412 that is disposable between the ends of the two casing sections 403, 404. The plug 400, in turn, is attached to the retaining member 410 using a shearable member 420. The plug 400 and the retaining member 410 include a bore 422 for fluid flow therethrough. The plug 400 also includes a seat 425 for receiving an actuatable device such as a ball or dart. Preferably, the retaining member 410 and the plug 400 are made of a drillable material, as is known to a person of ordinary skill in the art. It must be noted that although only one plug is shown, more than one plug may be attached to the retaining member for multiple plug releases.

In operation, a ball dropped from the launching tool 360 will travel in the wellbore until it lands in the seat 425 of the plug 400, thereby closing off fluid flow downhole. Thereafter, increase in pressure behind the ball will cause the shearable member 420 to fail, thereby releasing the plug 400 from the retaining member 410. In this manner, a plug 400 may be released from various locations in the wellbore.

Figure 8B:
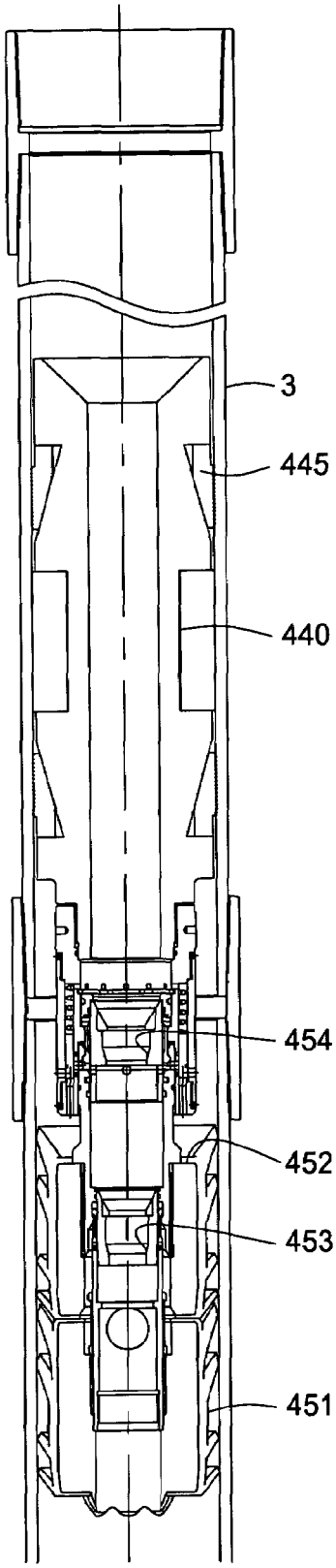
FIG. 8B illustrates an embodiment of retaining a plug in a casing string.
Figure 8C:
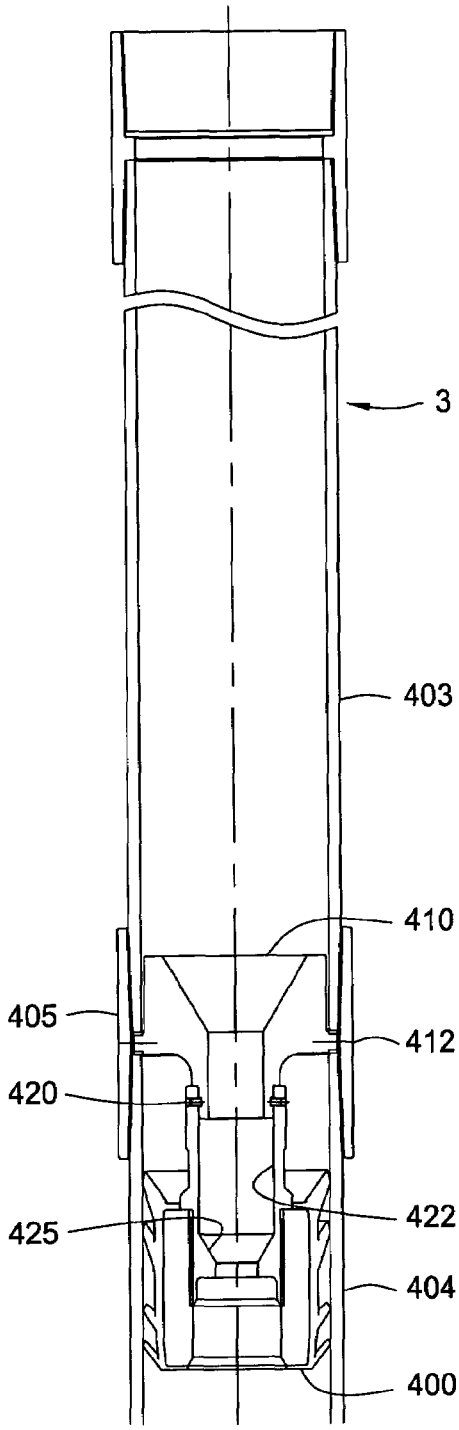
FIG. 8C illustrates another embodiment of retaining a plug in a casing string.

FIG. 8B shows another embodiment of coupling the plug to the casing string. In this embodiment, the retaining member comprises a packer 440. The packer 440 may comprise a drillable packer, a retrievable packer, or combinations thereof. The packer 440 includes one or more engagement members 445 for gripping the wall of the casing 3. An exemplary packer is disclosed in U.S. Pat. No. 5,787,979, which patent is herein incorporated by reference in its entirety. As shown, two plugs 451, 452 are selectively attached to the packer 440 and are adapted for release by an actuatable device such as a ball. Preferably, the first, or lower, plug 451 has a ball seat 453 that is smaller than the ball seat 454 of the second, or upper, plug 452. In this respect, a smaller ball launched from the launching tool may bypass the second plug 452 and land in the seat 453 of the first plug 451, thereby releasing the first plug 451. Thereafter, the second plug 452 may be released by a larger second ball. In this manner, the plugs 451, 452 may be selectively released from the packer 440. After the plugs 451, 452 have been released, the packer 440 may be retrieved or drilled through.

In another embodiment, the launching tool may be installed on an access tool similar to the one shown in FIG. 3. For example, the sheave assembly 236 and pack-off 235 may be removed and a launching tool such as a ball launcher with a top entry may be installed on a side portion 233. In this respect, one or more balls may be launched to release one or more cementing plugs located below the spear or torque head.

Figure 9:
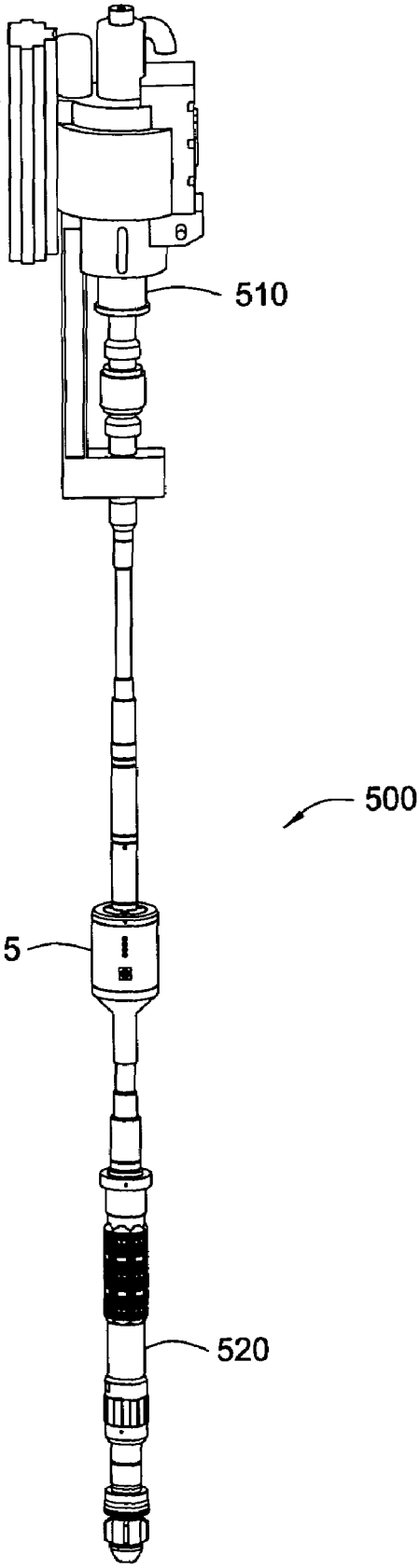
FIG. 9 shows an alternative top drive system having a cementing tool.

In another aspect, the top drive system 500 may include a top drive 510, a cementing tool 515, and a top drive adapter, as illustrated in FIG. 9. As shown, the top drive adapter comprises a spear 520. The cementing tool 515 is adapted to selectively block off fluid flow from the top drive 510 during cementing operations.

Figure 10:
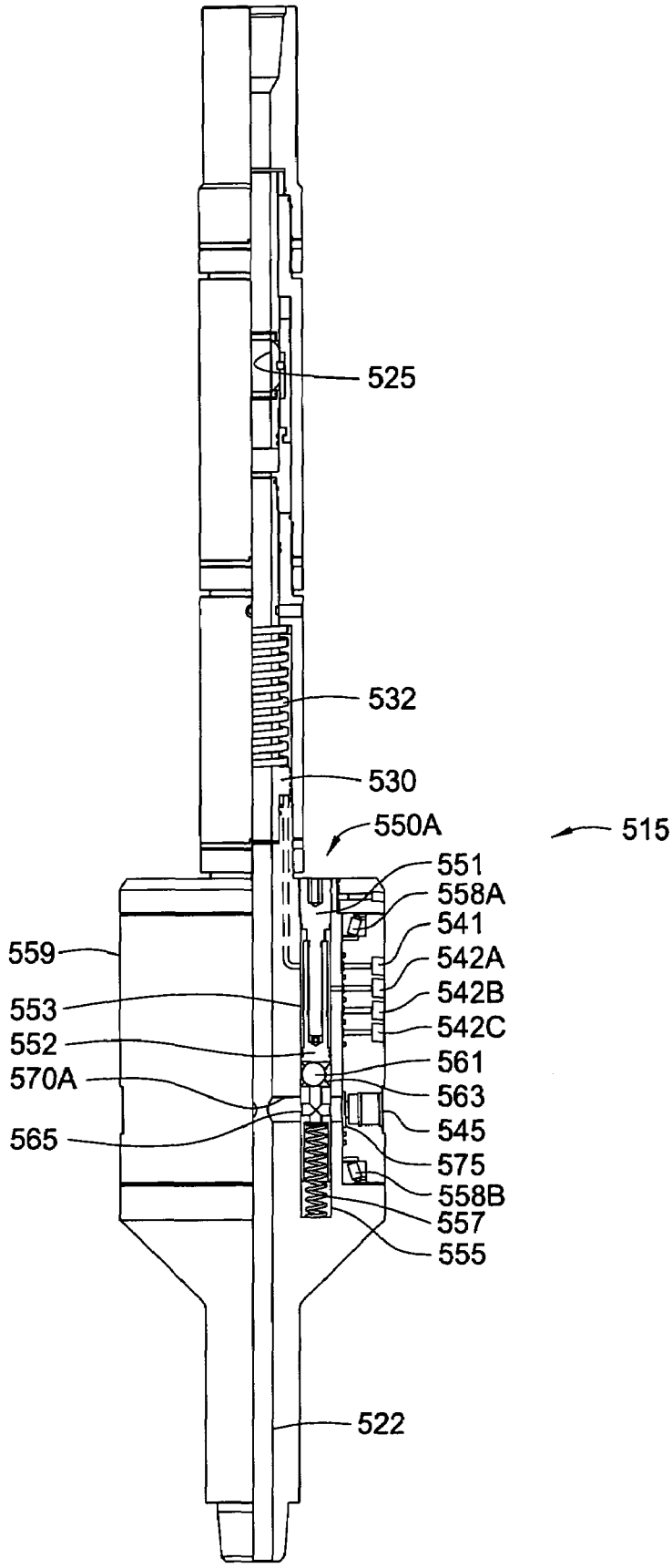
FIG. 10 is a partial cross-sectional view of the cementing tool of FIG. 9.

FIG. 10 is a partial cross-sectional view of an embodiment of the cementing tool 515. The cementing tool 515 includes a central bore 522 for fluid communication with the top drive 510 and the spear 520. A valve 525 is disposed in an upper portion of the bore 522 to selectively block off fluid communication with the top drive 510. The valve 525 is actuated between an open position and a close position by operation of a piston 530. As shown, the piston 530 is biased by a biasing member 532 to maintain the valve 525 in the open position. To close the valve 525, an actuating fluid is introduced through a fluid port 541 to move the piston 530 toward the valve 525. In this respect, movement of the piston 530 compresses the biasing member 532 and closes the valve 525, thereby blocking off fluid communication of the cementing tool 515 and the top drive 510. Thereafter, cement may be introduced into the bore 522 through the cementing port 545.

In another aspect, the cementing tool 515 may be adapted to release one or more actuating devices into the wellbore. In the embodiment shown in FIG. 10, the cementing tool 515 is adapted to selectively launch three balls 561. It must be noted that the cementing tool 515 may be adapted to launch any suitable number or type of actuating devices. Each ball 561 is retained by a release piston 550A before being dropped into the wellbore. The piston 550A is disposed in an axial channel 555 formed adjacent to the bore 522. In one embodiment, the piston 550A has a base 551 attached to the body of the cementing tool 515 and a piston head 552 that is extendable or retractable relative to the base 551. The outer diameter of a portion of the piston head 552 is sized such that an annulus 553 is formed between the piston head 552 and the wall of the axial channel 555. Seal members or o-rings may be suitably disposed in the base 551 and the piston head 552 to enclose the annulus 553. The annulus 553 formed is in selective fluid communication with an actuating fluid port 542A. In this respect, the actuating fluid may be supplied into the annulus 553 to extend the piston head 552 relative to the base 551, or relieved to retract the piston head 552. Preferably, the piston head 552 is maintained in the retracted position by a biasing member 557, as shown FIG. 10.

The release piston 550A is provided with an opening 563 to house the ball 561 and a cement bypass 565. In the retracted position shown, the cement bypass 565 is in fluid communication with a radial fluid channel 570A connecting the cement port 545 to the bore 522. In this respect, cementing fluid may be supplied into the bore 522 without causing the ball 561 to release. When the piston head 552 is extended, the opening 563 is, in turn, placed in fluid communication with the radial fluid channel 570A.

Figure 10A:
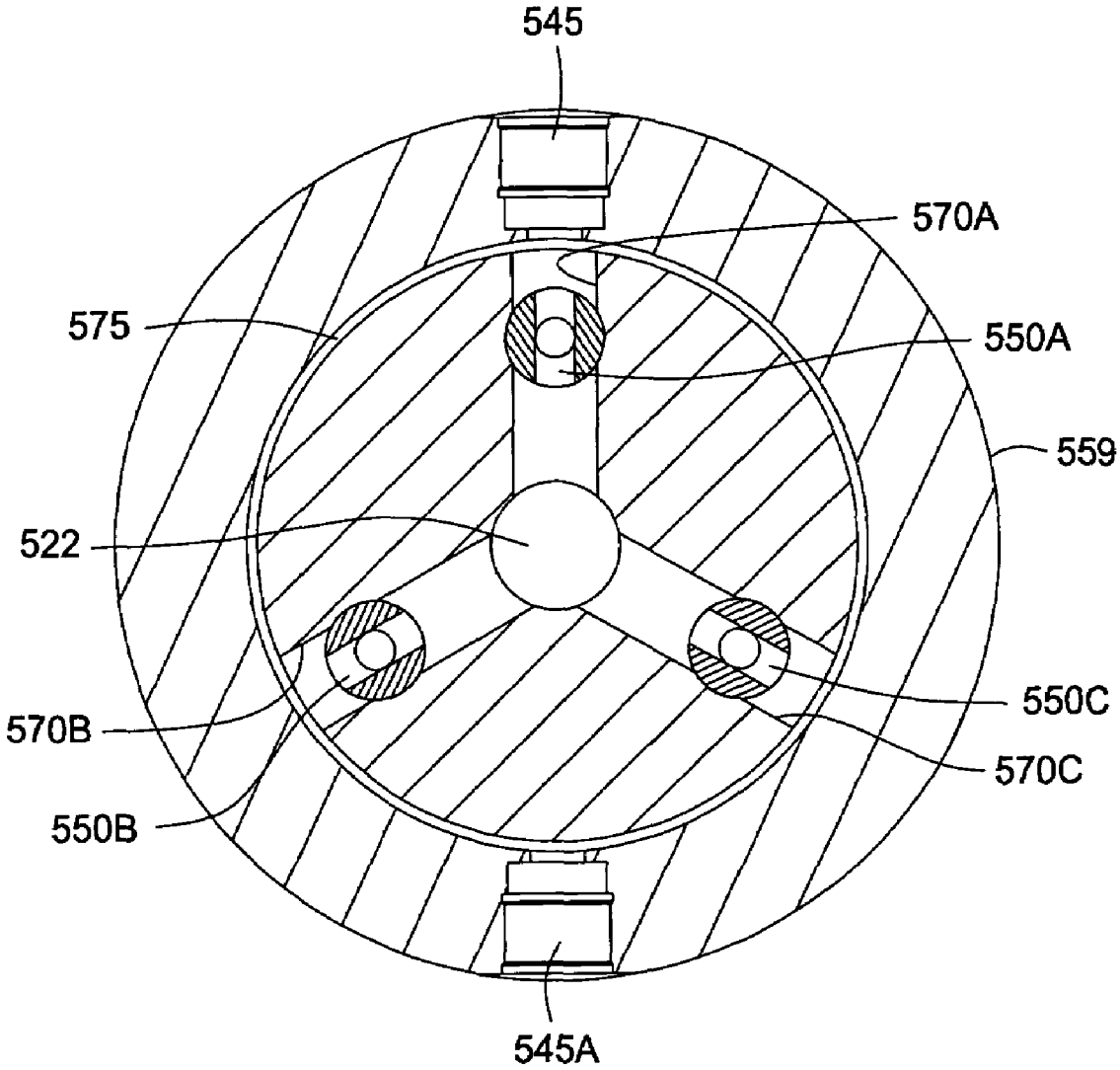
FIG. 10A is another cross-sectional view of the cementing tool of FIG. 9.

As discussed, the cementing tool 515 may be adapted to release one or more actuating devices. In the cross-sectional view of FIG. 10A, it can be seen that three release pistons 550A, 550B, 550C are circumferentially disposed around the bore 522. Cementing fluid coming in from either of the cementing ports 545, 545A is initially circulated in an annular channel 575. Three radial fluid channels 570A, 570B, 570C connect the annular channel 575 to the bore 522 of the cementing tool 515. Each radial fluid channel 570A, 570B, 570C also intersect the cement bypass 565 of a respective release piston 550A, 550B, 550C.

To release the first ball 561, actuating fluid is introduced through the fluid port 542A and into the annulus 553 of the first release piston 550A. In turn, the piston head 552 is extended to place the opening 563 in fluid communication with the radial fluid channel 570A. Thereafter, cement flowing through the cementing port 545, the annular channel 575, and the radial channel 570A urges to the ball 561 toward the bore 522, thereby dropping the ball 561 downhole. Because either position of the piston head 552 provides for fluid communication with the cementing port 545, the piston head 552 may remain in the extended position after the first ball 561 is released.

To release the second ball, actuating fluid is introduced through the second fluid port 542B and into the annulus 553 of the second release piston 550B. In turn, the piston head 552 is extended to place the opening 563 in fluid communication with the radial fluid channel 570B. Thereafter, cement flowing through the radial channel 570B urges to the ball 561 toward the bore 522, thereby dropping the ball 561 downhole. The third ball may be released in a similar manner by supplying actuating fluid through the third fluid port 542C.

In another aspect, the cementing tool 515 may optionally include a swivel mechanism to facilitate the cementing operation. In one embodiment, the fluid ports 541, 542A, 542B, 542C and the cementing port 545 may be disposed on a sleeve 559. The sleeve 559 may be coupled to the body of the cementing tool using one or more bearings 558A, 558B. As shown in FIG. 10, two sets of bearings 558A, 558B are disposed between the sleeve 559 and the body of the cementing tool 515. In this respect, the body of the cementing tool 515 may be rotated by the top drive 10 without rotating the ports 541, 542A, 542B, 542C, 545 and the fluid lines connected thereto. During the cementing operation, the swivel mechanism of the cementing tool 515 allows the top drive 10 to rotate the drill string 3, thereby providing a more efficient distribution of cementing in the wellbore.

In another embodiment, the cementing tool 515 may include additional fluid ports to introduce fluid into the top drive system. For example, hydraulic fluids may be supplied through the additional fluid ports to operate the spear, torque head, weight/thread compensation sub, or other devices connected to the top drive. Additionally, operating fluids may also be supplied through one of the existing ports 541, 542A, 542B, 542C, 545 of the cementing tool 515.

While the foregoing is directed to embodiments of the present invention, other and further embodiments of the invention may be devised without departing from the basic scope thereof, and the scope thereof is determined by the claims that follow.

We claim:

1. A top drive system for handling a casing, comprising:

a top drive;

a top drive adapter having radially movable gripping elements for gripping the casing, the top drive adapter operatively connected to the top drive; and an access tool disposed between the top drive adapter and the top drive and adapted for a conveying member to access a fluid passage of the top drive system, wherein the conveying member is at least partially inserted into the fluid passage.

2. The system of claim 1, wherein the conveying member comprises a wireline.

3. The system of claim 1, wherein the access tool comprises a sealing member adapted to prevent leakage of fluid from the access tool.

4. The system of claim 1, wherein the access tool comprises a sealing member for maintaining a pressure in the access tool.

5. The system of claim 1, further comprising a sheave assembly to facilitate movement of a conveying member.

6. The system of claim 1, wherein the access tool is disposed on an upper portion of the top drive.

7. The system of claim 1, wherein the access tool comprises a central bore and a side entry bore in fluid communication with the central bore.

8. The system of claim 1, wherein the access tool comprises a manifold that separates a fluid flow in the access tool into at least two flow paths.

9. The system of claim 1, wherein the top drive adapter comprises a torque head or a spear.

10. The top drive system of claim 1, wherein the access tool includes two entry bores in fluid communication with the fluid passage.

11. The top drive system of claim 10, wherein a first bore intersects a second bore.

12. The top drive system of claim 1, wherein the access tool includes a first bore in axial alignment with the fluid passage and a second bore intersecting the fluid passage.

13. A method for retrieving a downhole tool through a tubular using a top drive adapter of a top drive system, comprising:

coupling an access tool to the top drive system, wherein the access tool is adapted to provide access to a fluid path in the top drive system and the top drive adapter includes radially movable gripping elements;

moving the top drive system including the access tool and the top drive adapter into engagement with the tubular;

inserting a conveying member into the fluid path through the access tool;

coupling the conveying member to the downhole tool; and retrieving the downhole tool.

14. The method of claim 13, further comprising reciprocating the tubular.

15. The method of claim 14, wherein reciprocating the tubular comprises axially moving the tubular.

16. The method of claim 13, further comprising circulating fluid to the tubular.

17. The method of claim 13, wherein the tubular comprises a casing.

18. The method of claim 13, wherein engagement with the tubular comprises gripping the tubular using the top drive adapter.

19. A top drive system for drilling with casing, comprising:

a top drive;

a top drive adapter for gripping the casing, the top drive adapter operatively connected to the top drive; and an access tool operatively connected to the top drive and adapted for accessing a fluid passage of the top drive system and includes a manifold that separates a fluid flow in the access tool into at least two flow paths.

20. The top drive system of claim 19, wherein the access tool includes an opening in axial alignment with the top drive adapter.

21. The top drive system of claim 20, further comprising a sheave wheel.

22. A method for retrieving a downhole tool through a tubular using a top drive system, comprising:

providing the top drive system with a gripping tool coupled to an access tool, wherein the access tool is adapted to provide access to a fluid path in the top drive system and wherein the gripping tool includes radially movable gripping elements;

moving the gripping tool and the access tool toward the tubular;

engaging the tubular using the access tool;

inserting a conveying member into the fluid path through the access tool;

coupling the conveying member to the downhole tool; and retrieving the downhole tool.

23. The method of claim 22, wherein the access tool is connected to a lower portion of the gripping tool.

24. A method for retrieving a downhole tool through a tubular using a top drive system having a gripping tool, comprising:

gripping an access tool using the gripping tool, the access tool adapted to provide access to a fluid path in the top drive system;

moving the gripping tool and the access tool toward the tubular;

engaging the tubular using the access tool;

inserting a conveying member into the fluid path through the access tool;

coupling the conveying member to the down hole tool; and retrieving the downhole tool.

25. The method claim 24, further comprising gripping and releasing the tubular prior to gripping the access tool.

26. The method of claim 25, wherein the gripping tool includes radially movable gripping elements.

27. The method of claim 26, wherein the access tool is connected to an upper portion of the gripping tool.

28. A method for retrieving a downhole tool through a tubular using a top drive system, comprising:

providing the top drive system with a gripping tool coupled to an access tool, wherein the access tool is adapted to provide access to a fluid path in the top drive system and wherein the gripping tool includes radially movable gripping elements;

moving the gripping tool and the access tool toward the tubular;

gripping the tubular using the gripping tool;

inserting a conveying member into the fluid path through the access tool;

coupling the conveying member to the downhole tool; and retrieving the downhole tool.

29. The method of claim 28, wherein the access tool is connected to an upper portion of the gripping tool.

30. A top drive system for handling a casing, comprising:

a top drive:

a top drive adapter having radially movable gripping elements for gripping the casing, the top drive adapter operatively connected to the top drive; and an access tool disposed between the top drive adapter and the top drive and adapted for accessing a fluid passage of the top drive system wherein the access tool includes a first bore in fluid communication with the fluid passage of the top drive system and a second bore intersecting the first bore.

31. The top drive system of claim 30, wherein a conveying member is inserted into the fluid passage through the second bore.

32. The top drive system of claim 31, wherein the conveying member comprises a wireline.

33. The top drive system of claim 30, wherein the access tool comprises a sealing member adapted to prevent leakage of fluid from the access tool.

34. The top drive system of claim 30, wherein the access tool comprises a sealing member for maintaining a pressure in the access tool.

35. The top drive system of claim 30, further comprising a sheave assembly to facilitate movement of a conveying member.

36. The top drive system of claim 30, wherein the access tool includes a tubular retaining device for engaging the casing.

37. The top drive system of claim 30, wherein the second bore is formed through an axial wall of the access tool.

38. A method of conveying a downhole tool in a tubular, comprising:

providing a gripping tool coupled to an access tool, wherein the access tool is adapted to provide access to a fluid path in the tubular and wherein the gripping tool includes radially movable gripping elements;

moving the gripping tool and the access tool toward the tubular;

engaging the tubular using the access tool;

inserting a conveying member into the fluid path through the access tool;

coupling the conveying member to the downhole tool; and conveying the downhole tool.

39. The method of claim 38, wherein the access tool includes an axial bore and a side entry port in fluid communication with the axial bore.

40. The method of claim 38, wherein the access tool is connected to a lower portion of the gripping tool.

41. The method of claim 38, further comprising coupling the access tool or the gripping tool to a top drive motor.

42. The method of claim 38, wherein the access tool includes a tubular retaining device for engaging the tubular.

43. The method of claim 42, wherein the tubular retaining device is one of spear, torque head, or casing collar clamp.

44. A top drive system for handling a casing, comprising:

a top drive;

a top drive adapter having radially movable gripping elements for gripping the casing, the top drive adapter operatively connected to the top drive; and an access tool disposed between the top drive adapter and the top drive and adapted for accessing a fluid passage of the top drive system, wherein the access tool comprises a central bore and a side entry bore in fluid communication with the central bore.

45. A top drive system for handling a casing, comprising:

a top drive;

a top drive adapter having radially movable gripping elements for gripping the casing, the top drive adapter operatively connected to the top drive; and an access tool disposed between the top drive adapter and the top drive and adapted for accessing a fluid passage of the top drive system, wherein the access tool comprises a manifold that separates a fluid flow in the access tool into at least two flow paths.

46. A top drive system for handling a casing, comprising:

a top drive;

a top drive adapter having radially movable gripping elements for gripping the casing, the top drive adapter operatively connected to the top drive; and an access tool disposed between the top drive adapter and the top drive and adapted for accessing a fluid passage of the top drive system, wherein the access tool comprises a launching tool adapted to release a ball or a plug.

47. A method for conveying a downhole tool through a tubular using a top drive adapter of a top drive system, comprising:

coupling an access tool to the top drive system, wherein the access tool is adapted to provide access to a fluid path in the tubular and the top drive adapter includes radially movable gripping elements;

moving the top drive system including the access tool and the top drive adapter into engagement with the tubular;

inserting a conveying member into the fluid path through the access tool;

coupling the conveying member to the downhole tool; and conveying the downhole tool.

48. The method of claim 47, wherein the access tool includes an axial bore and a side entry port in fluid communication with the axial bore.

49. The method of claim 47, wherein coupling the access tool comprises gripping the access tool using the top drive adapter.

50. The method of claim 47, further comprising reciprocating the tubular.

51. The method of claim 47, wherein conveying the downhole tool comprises retrieving the downhole tool.

52. The method of claim 47, wherein conveying the downhole tool comprises running wireline operations.

53. A method for conveying a downhole tool through a tubular using a top drive system having a gripping tool, comprising:

gripping an access tool using the gripping tool, the access tool adapted to provide access to a fluid path in fluid communication with the top drive system;

moving the gripping tool and the access tool toward the tubular;

engaging the tubular using the access tool;

inserting a conveying member into the fluid path through the access tool;

coupling the conveying member to the downhole tool; and conveying the downhole tool.

54. The method of claim 53, wherein the access tool includes an axial bore and a side entry port in fluid communication with the axial bore.

* * * * *